US005247763A

United States Patent [19]

Hein

[11] Patent Number: 5,247,763

[45] Date of Patent: Sep. 28, 1993

[54] AUTOMATIC SLIDING DOOR

[75] Inventor: Christian Hein, Langenhagen, Fed. Rep. of Germany

[73] Assignee: Dorma GmbH & Co. K.G., Ennepetal, Fed. Rep. of Germany

[21] Appl. No.: 773,632

[22] PCT Filed: May 8, 1990

[86] PCT No.: PCT/DE90/00326

§ 371 Date: Jun. 17, 1992

§ 102(e) Date: Jun. 17, 1992

[87] PCT Pub. No.: WO90/13723

PCT Pub. Date: Nov. 15, 1990

[30] Foreign Application Priority Data

May 10, 1989 [DE] Fed. Rep. of Germany ..... 3915241

[51] Int. Cl.[5] ..... E05F 15/20

[52] U.S. Cl. ..... 49/31; 49/123; 49/141; 49/360; 49/404

[58] Field of Search ..... 49/31, 141, 118, 123, 49/139, 360, 379, 404

[56] References Cited

U.S. PATENT DOCUMENTS

| | | | |
|---|---|---|---|
| 2,338,030 | 12/1943 | Edgemond | 49/379 X |
| 2,925,860 | 2/1960 | Dunn | 49/379 X |
| 3,571,973 | 3/1971 | Roberts | 49/31 X |
| 4,003,102 | 1/1977 | Hawks et al. | 49/404 X |
| 4,738,052 | 4/1988 | Yoshida | 49/31 |
| 4,893,435 | 1/1990 | Shalit | 49/139 X |
| 5,127,190 | 7/1992 | Hein et al. | 49/31 |

FOREIGN PATENT DOCUMENTS

| | | |
|---|---|---|
| 495813 | 9/1977 | Australia . |
| 570637 | 3/1988 | Australia . |
| 0175194 | 3/1986 | European Pat. Off. . |
| 3202898 | 8/1983 | Fed. Rep. of Germany . |

*Primary Examiner*—Philip C. Kannan
*Attorney, Agent, or Firm*—Max Fogiel

[57] ABSTRACT

An automatic sliding door in which a main drive moves at least one door panel to open and closed positions. An electromagnetic clutch is located between the main drive and the door panel for the purpose of disconnecting the panel from the drive and to open the door in event of a power failure. An auxiliary drive is connected to the door panel and stores energy received when the door panel is in a closed position, so as to drive the door to the open position when the clutch disconnects the main drive from the door panel in event of power failure. The auxiliary drive has a rubber cable actuated always with the door so that the auxiliary drive can be tested with every movement of the door panel.

6 Claims, 3 Drawing Sheets

AUTOMATIC SLIDING DOOR

BACKGROUND OF THE INVENTION

The domestic legislation of almost every nation in the world now requires doors, especially those in such public buildings as railroad stations, department stores, auditoriums, etc., to be constructed so as to be manageable by people in wheelchairs, with baby carriages, or on crutches without assistance. The doors must also be capable of rapidly, reliably, and smoothly opening wide in an emergency to allow the people inside to escape.

The former requisite, ensuring access to handicapped people, can usually be satisfied only with automatic sliding doors. Existing sliding doors, however, are not appropriate for ensuring escape and rescue routes as well.

A two-panel automatic sliding door especially intended to provide escape and rescue routes is known from French A 1 374 224. Each panel has a swinging component articulated to a non-swinging component. The swinging component of the panel snaps into the non-swinging component such that, when the middle of the door is pressed from inside, the swinging component will also open out.

A similar sliding door, which divides more or less at the middle, is disclosed in Swiss A 508 122. Dividing a two-panel door at the middle is known from U.S. Pat. No. 3,811,489. Although this approach does unobstruct the escape route to a certain extent in an emergency, it is an unsatisfactory solution.

A mechanism for closing a sliding gate can be derived from German Patent 2 853 772. The gate's drive mechanism is coupled in through a variable electromagnetic clutch and a downstream friction clutch. Once the gate's panel has been swung out and the rotary clutch is disconnected from the friction clutch, the resultant torque stored in an operations reservoir will be powerful enough to restore the panel. Closing mechanisms of this type are employed in particular in fire doors.

A two-panel automatic sliding door is known from European Patent A 163 942. Each panel has a swinging component articulated to a sliding but non-swinging component and resiliently secured such that, when the middle of the door is pressed from inside, the swinging components will swing out and simultaneously force the non-swinging components back.

In this embodiment as well, pressure must be applied from inside against the swinging components before they will swing out. In the event of a power failure, the two other components will not travel back, and the free access is sometimes so small that people hurling themselves against it in a panic will be injured or even killed.

SUMMARY OF THE INVENTION

The object of the present invention is accordingly an automatic sliding door that will open automatically in the event of a power failure no matter what overall state it is in. The door will always open in other words when its supply of electricity is cut off, whether or not there is an emergency, and will ensure free access. Furthermore, the drive mechanism is intended to be as cost-effective as possible.

This object is attained in accordance with the invention by an auxiliary drive mechanism that is supplied with energy when the door is closed normally, retains that energy, and becomes active in the event of a power failure accompanied by simultaneous uncoupling of the main drive mechanism when the door opens. This approach eliminates the need for a redundant overall main drive mechanism.

A preferably electromagnetic clutch between the drive mechanism and the door panel or panels interrupts or disengages the door's normal operations by disconnecting the drive mechanism from one or both doors in the event of a power failure. The same procedure will occur when there is a malfunction or disruption in the supply of emergency current.

The auxiliary drive mechanism can be any appropriate reservoir, a hydraulic or pneumatic pressure reservoir for example, or resilient structures. Preferably, however, the auxiliary drive mechanism in the sense of the present invention will comprise an elastic rubber structure connected at one end to the door's springer and at the other to its panel. The elastic structure can of course be made of another material (plastic e.g.). To ensure that the elastic structure will be able to store enough energy to open the door, it is wrapped around a pulley to increase its length. It can also be adjusted with respect to thickness and elasticity.

Since simultaneous operation of both panels in two-panel doors for example is ensured by coupling both to the same drive mechanisms, the elastic structure needs to be connected to only one panel or to the drive mechanism at an appropriate point. The drive mechanism can be a cogged belt for example. The motor and transmission will accordingly operate an output in the form of a cogwheel by way of an electromagnetic clutch. The drive mechanism in a single-panel door is analog. If the internal or external supply of power is interrupted for any reason, or if there is a total power failure, no more electricity will be forwarded to the electromagnetic clutch. This event can also be accompanied by the triggering of an alarm, a fire alarm for example, when the circuitry is appropriate. The train from the motor to the belt cogwheel by way of the transmission will be interrupted. The transmission will stop blocking the panels. The tensioned elastic structure will contract and drag the now freely moving panel open, making the whole doorway accessible.

No human physical contact with the panels is necessary to open the sliding door.

This approach avoids the need for complex machinery involving two main drive mechanisms. The auxiliary drive mechanism operates strictly mechanically and represents a cost-effective alternative to two drive mechanisms.

BRIEF DESCRIPTION OF THE DRAWINGS

The invention will now be described in detail with reference to one embodiment illustrated schematically in the accompanying drawing, wherein.

BRIEF DESCRIPTION OF THE PREFERRED EMBODIMENTS

Figure 1:
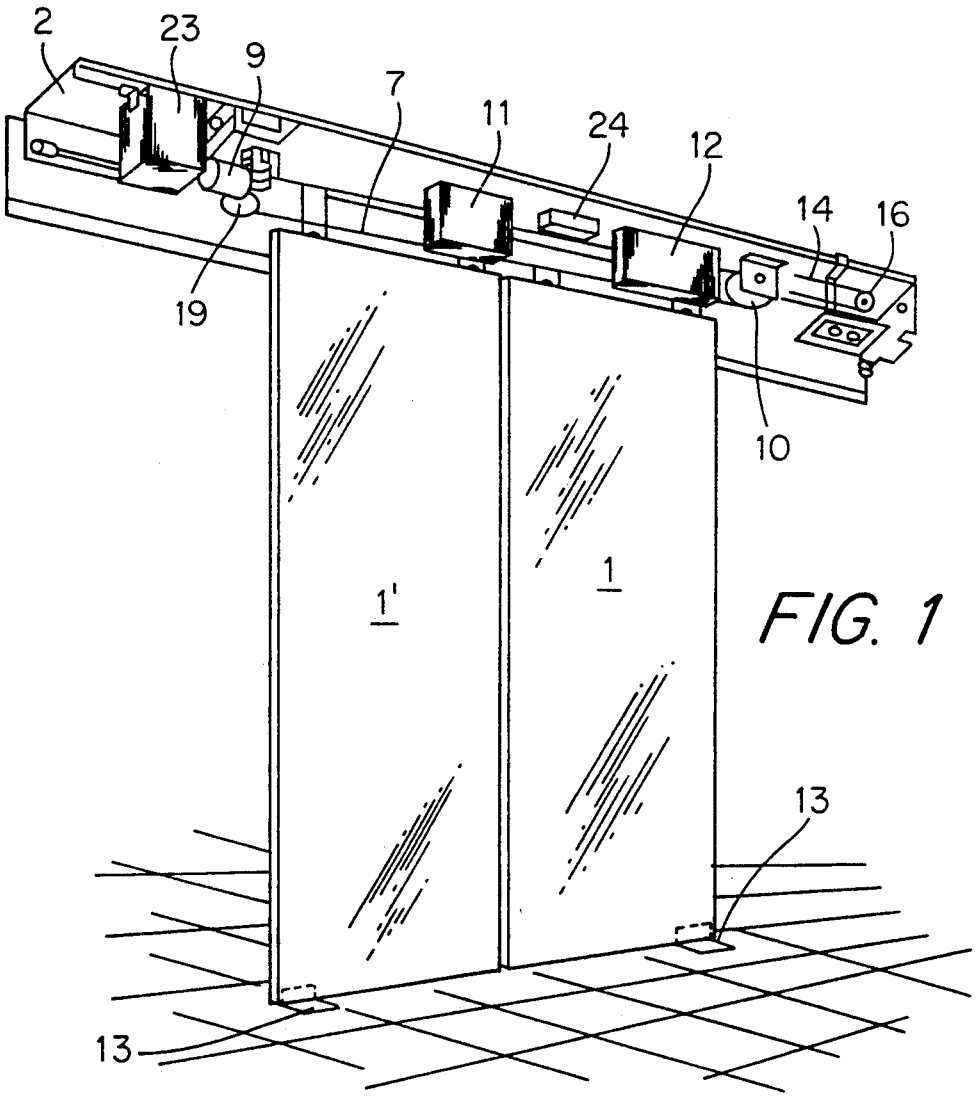
FIG. 1 is a schematic perspective view of a sliding door in accordance with the invention.

FIG. 1 is a schematic perspective view of a sliding door in accordance with the invention with two panels. The two panels 1 and 1' are suspended in a known way from a springer 2 with an air rail on carriage 3 by way of suspensions 4 with rollers 5 and an anti-derailer 6.

Panels 1 and 1' are activated by way of a drive mechanism 7. This mechanism can be a cogged belt driven by a cogwheel on a motor with a transmission 9 and an electromagnetic clutch 20. Drive mechanism 7 is a continuous belt and is secured in a way that is in itself known to the panels. It travels around a deflection disk 10 at the end opposite the motor.

Normally, the sliding door is operated by way of corresponding controls and monitoring devices 11 and 12. At the bottom it travels in appropriate floor-mounted guides 13. The invention is embodied as will be evident in particular from FIG. 2 in an elastic rubber structure 14 attached at point 15 to the carriage 21 for door panel 1. Elastic structure 14 extends thence around a deflection roller 16 and back toward a point 17 above panel 1 and carriage 21 to an attachment 18 on springer 2.

A driving cogwheel 19 is connected to a transmission 22 associated with a motor 9 by way of an electromagnetic clutch 20. Also illustrated in FIG. 1 is a power supply 23 and a door lock 24.

How the invention works will be evident from the foregoing description. Normally, the sliding door is activated by controls and monitoring devices when energy is supplied to drive motor 9. The door opens and closes by way of the transmission motor, which displaces the cogged belt one way to open the panels and the other to close them.

Figure 2:
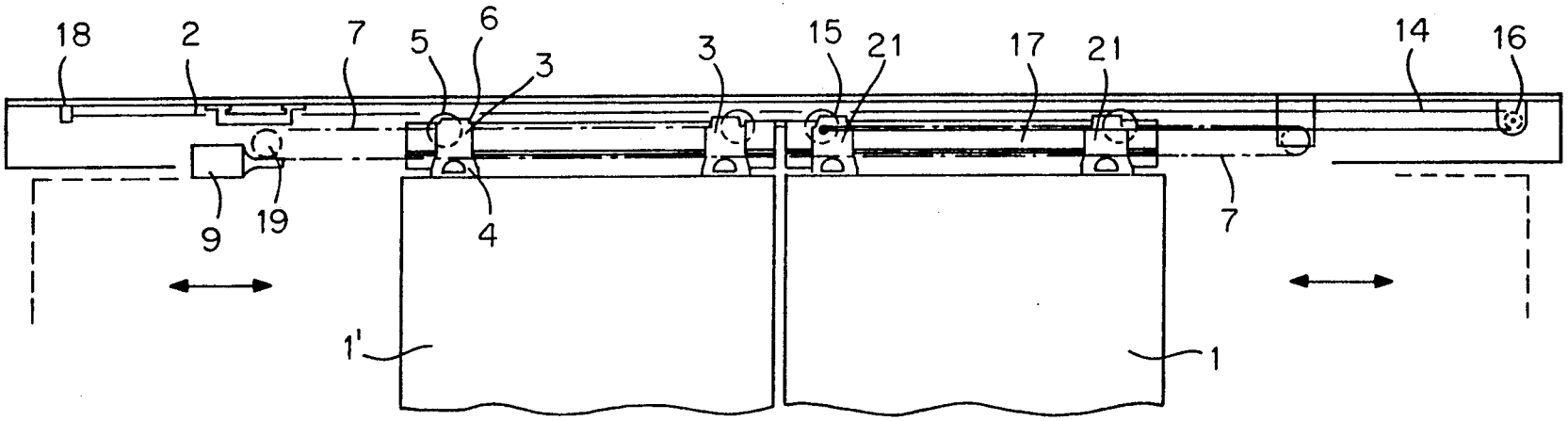
FIG. 2 is a schematic view of a two-panel sliding door with an auxiliary (redundant) drive mechanism.
Figure 3:
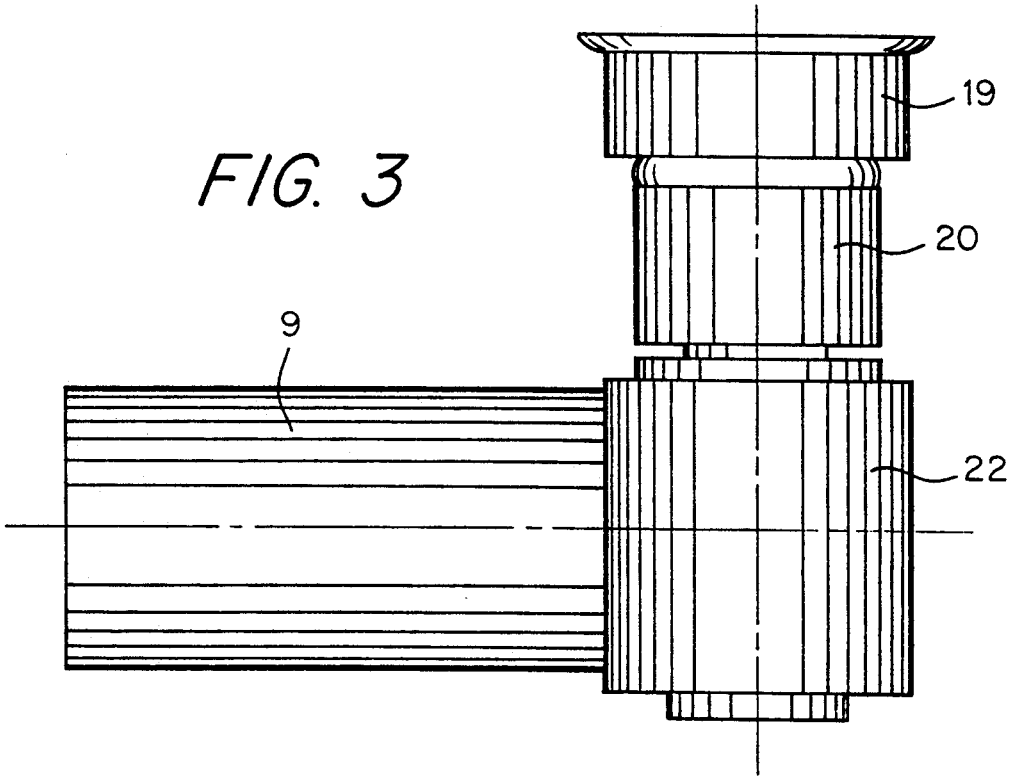
FIG. 3 illustrates a motor with a clutch and belt cogwheel for normal door operation.

Since, as will be evident from FIG. 2, one end 18 of elastic structure 14 is attached to the springer and its other end 15 to a carriage on panel 1, it will store energy. This energy is released when the flow of current through electromagnetic clutch 20 is interrupted, disengaging the clutch between the motor and driving cogwheel 19. The cogwheel is no longer mechanically connected to the motor. The tensioned elastic structure can now contract and open the sliding door.

Since panels 1 and 1' are connected by way of drive mechanism 7, the elastic structure will act on both panels and open them.

Instead of attaching the rubber structure to panel 1 at point 15, it could be attached to panel 1', although its other end would be fastened not at attachment 18 but at the opposite end of springer 2. Deflection roller 16 would in this case be near attachment 18.

As hereintofore described, the door panels always open when there is basically no current being supplied. The sliding door's circuitry can also be designed to interrupt the supply of current in the event of a fire alarm or when a similar emergency or hazard occurs. The operation will then be initiated by appropriate controls.

Using a rubber structure 14 constitutes a simple, advanced, and practical solution in accordance with the invention. Elastic structure 14 can, however, also be replaced by any other energy-storing structure that will act similarly on the sliding door—a mechanical spring or piston and cylinder with appropriate rods and a fluid reservoir for example. Such mechanisms will also ensure reliable function on the part of the sliding door in the event of an emergency.

I claim:

1. An automatic sliding door comprising: at least one door panel; main drive means for driving said door panel to an open position and a closed position; clutch means between said main drive means and said panel for disconnecting said panel from said main drive means to open said door in event of a power failure; auxiliary drive means connected to said door panel and storing energy received when said door panel is in said closed position for driving said door panel to said open position when said clutch means disconnects said main drive means from said panel in event of power failure; said auxiliary drive means having a rubber cable actuated always with said door so that said auxiliary drive means can be tested with every movement of said door panel.

2. An automatic sliding door as defined in claim 1, wherein said clutch means comprises an electromagnetic clutch.

3. An automatic sliding door as defined in claim 1, including supporting springer means, said rubber cable being connected to said springer means and to said door panel.

4. An automatic sliding door as defined in claim 3, including a deflection roller, said rubber cable traveling around said deflection roller.

5. An automatic sliding door as defined in claim 1, wherein said main drive means comprises a motor with transmission means; a cogwheel on said motor; a cogged belt driven by said cogwheel and secured to said door panel and traveling around a disc at an end opposite said motor; a carriage on said door panel, said rubber cable being attached at a point to said carriage; a deflection roller, said rubber cable extending around said deflection roller and toward a point above said door panel and said carriage to an attachment on a supporting springer for supporting said auxiliary drive means.

6. An automatic sliding door comprising: at least one door panel; main drive means for driving said door panel to an open position and a closed position; clutch means between said main drive means and said panel for disconnecting said panel from said main drive means to open said door in event of a power failure; auxiliary drive means connected to said door panel and storing energy received when said door panel is in said closed position for driving said door panel to said open position when said clutch means disconnects said main drive means from said panel in event of power failure; said auxiliary drive means having a rubber cable actuated always with said door so that said auxiliary drive means can be tested with every movement of said door panel; said clutch means being an electromagnetic clutch; supporting springer means for supporting said auxiliary drive means, said rubber cable being connected to said springer means and to said door panel; a deflection roller, said rubber cable traveling about said deflection roller; said auxiliary drive means comprising a motor with transmission means, a cogwheel on said motor, a cogged belt driven by said cogwheel and secured to said door panel and traveling around a deflection disc at an end opposite said motor, a carriage on said door panel and having a point attached to said rubber cable, said rubber cable extending around said deflection roller and toward a point above said door panel and said carriage to an attachment on said springer means, said cogwheel being connected to said transmission means through said clutch means.

* * * * *